US005531415A

United States Patent [19]

Kallemeyn

[11] Patent Number: 5,531,415

[45] Date of Patent: Jul. 2, 1996

[54] TOOL HOLDER SYSTEM

[76] Inventor: Hogen J. Kallemeyn, P.O. Box 2039, Blue Jay, Calif. 92317

[21] Appl. No.: 310,155

[22] Filed: Sep. 21, 1994

[51] Int. Cl.[6] ..... A47F 5/00

[52] U.S. Cl. ..... 248/220.31; 211/59.1

[58] Field of Search ..... 211/60.1, 65, 66, 211/69, 70.6, 57.1, 59.1, 106; 248/220.2, 220.31, 222.4, 225.2, 303, 339, 222.3

[56] References Cited

U.S. PATENT DOCUMENTS

| | | | |
|---|---|---|---|
| 1,140,940 | 5/1915 | Bales . | |
| 1,972,505 | 9/1934 | Wilson | 211/106 X |
| 2,527,713 | 10/1950 | Dunn | 211/106 X |
| 2,987,286 | 6/1961 | Alling | 248/223 |
| 3,091,423 | 5/1963 | Butterworth | 211/70.6 X |
| 3,255,987 | 6/1966 | Gatch | 248/223 |
| 3,310,271 | 3/1967 | King | 248/225 |
| 3,880,390 | 4/1975 | Niven | 248/223 |
| 4,480,755 | 11/1984 | Cartwright | 211/70.6 |
| 4,502,602 | 3/1985 | Swanson | 211/59.1 |
| 4,616,753 | 10/1986 | Aslan | 211/57.1 |
| 4,681,233 | 7/1987 | Roth | 211/70.6 |
| 4,723,663 | 2/1988 | Learn | 211/59.2 |
| 4,742,923 | 5/1988 | Calvert | 211/59.1 |
| 4,860,905 | 8/1989 | Schott et al. | 211/59.1 |
| 4,951,827 | 8/1990 | Moransais | 211/59.1 |
| 4,961,504 | 10/1990 | Larson et al. | 211/59.1 |

*Primary Examiner*—Alvin C. Chin-Shue
*Assistant Examiner*—Sarah L. Purol
*Attorney, Agent, or Firm*—Sheldon & Mak

[57] ABSTRACT

A tool holder for use in a wall panel having a panel thickness includes a circularly cylindrical anchor bar having a length greater than the width of a slot of the panel and not greater than the minimum length of the slot; a circularly cylindrical connector bar having the anchor bar extending beyond opposite sides of the connector bar; a base rigidly connected to the other end of the connector bar and extending on opposite sides thereof and spaced from the anchor bar by a spacing S not less than the panel thickness, the base extending in at least two intersecting directions on opposite sides of the connector at the spacing S from the anchor bar for contacting the panel at locations spaced about the connector bar and stabilizing the holder against tipping in any direction relative to the wall panel when the connector bar protrudes the slot with the anchor bar extending on opposite sides of the slot. The base includes opposite leg portions of a U-shaped arm that are rigidly connected from medial locations thereon to opposite sides of the connector bar, the leg portions being coplanar at the spacing S from the anchor bar, a portion of the arm projecting from the base for supporting an article thereon, the arm, the base, the anchor bar and the connector bar being formed of a wire material having a single uniform circular cross-sectional diameter that is not greater than the width of the slot.

11 Claims, 1 Drawing Sheet

TOOL HOLDER SYSTEM

BACKGROUND

Figure 1:
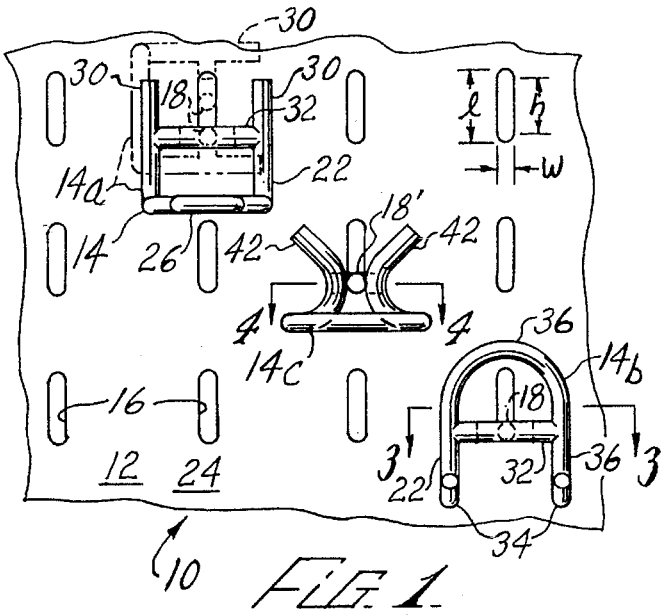

The present invention relates to hanger systems using apertured display panels for holding tools and objects such as goods on sale.

Peg board display panels are conventionally formed with a regular array of round passages therethrough. Heavy wire hooks are insertable in selected ones of the passages for hanging the objects. Each hook can have an S-shaped anchor extremity that extends through a circular passage, and a shank that is formed for supporting an object, the anchor extremity contacting the back side of the panel for preventing disengagement thereof when the shank is loaded by the object. A principal disadvantage of this construction is that the hooks can be inadvertently dislodged from engagement with the panel. This is particularly true when the object is being placed on or taken off of the hook.

Consequentially, numerous alternative hook configurations have been proposed, typically for use with panels having non-circular passages. For example, U.S. Pat. No. 3,310,271 to King discloses a slotted board and formed wire hardware having a key that is received through a selected slot when the hardware is turned from a normally horizontal position, the hardware being supported on the board after being allowed to assume the horizontal position. The hardware of King, while being less subject to dislodgement from the panel, is nevertheless not entirely satisfactory. For example:

1. The hardware is unstable, particularly in that most variations thereof are loosely fitted to the board whereby in some variations the hardware can be tipped upwardly while in the horizontal position, and in other variations the hardware is undesirably easily rotated from the horizontal position; and 2. The board is subject to being damaged by the hardware during normal use, in that the slots are loaded by curved portions of the hardware, particularly in configurations not loosely fitted to the board, subjecting the board to local compression failure, and in that the back side of the board is subject to excessive wear by an end extremity of the wire during engagement of the hardware.

U.S. Pat. No. 3,255,987 to Gatch, U.S. Pat. No. 3,880,390 to Niven, and U.S. Pat. No. 4,860,905 to Schott et al. disclose pegboards and hardware that are characterized by complex shapes that are expensive to produce, even in the typically disclosed molded plastic, tooling costs being especially high for injection molded parts. Molded plastic is also notoriously subject to degradation when exposed to sunlight. Further, the plastic hardware is only marginally suited for use supporting typical tools such as hammers and wrenches that have substantial weight. Moreover, the molded configurations are typically difficult to use in that apertures of the panel are not exposed to view, and the hardware and/or the panel must be awkwardly deformed during engagement thereof.

Thus there is a need for a tool holder system that is easily used without dislodging hardware thereof, that is inexpensive to produce, and that has substantial strength and durability for supporting tools of substantial weight.

SUMMARY

The present invention meets this need by providing a tool holder for use in a wall panel having a panel thickness, a slotted passage formed through the panel, the passage being of uniform width within a minimum length thereof. In one aspect of the invention, the holder includes a cylindrical anchor bar having a lateral thickness not greater than the width of the slot, and a length greater than the width of the slot and not greater than the minimum length of the slot; a cylindrical connector bar having opposite ends, one end thereof being rigidly connected perpendicular to the anchor bar, the connector bar having a cross-section inscribed within a diameter not greater than the width of the slot, the anchor bar extending beyond opposite sides of the connector bar; a base rigidly connected to the other end of the connector bar and extending on opposite sides thereof, the base being spaced from the anchor bar by a spacing S not less than the panel thickness; and an arm projecting from the base for supporting an article thereon.

The anchor bar and the connector bar can each be circularly cylindrical. The base can include a base rod of uniform cross-section that extends on opposite sides of the connector bar at the spacing S. The anchor bar, the connector bar, and the base rod can be formed of a wire material having a single uniform cross-section.

The arm can be U-shaped, the base further including opposite leg portions of the arm that are rigidly connected at medial locations thereon to respective ends of the base rod, the leg portions being coplanar with the base rod at the spacing S from the anchor bar. The leg portions can extend to respective end extremities of the arm, a central portion of the arm projecting away from the wall panel. Respective end portions of the arm can project away from the wall panel. The anchor bar, the connector bar, the base rod and the arm are formed of a wire material having uniform cross-section.

The arm can be U-shaped, the base including opposite leg portions of the arm that are rigidly connected from medial locations thereon to opposite sides of the connector bar, the leg portions being coplanar at the spacing S from the anchor bar. Preferably the leg portions are formed for contacting the wall panel at at least three spaced locations about the connector bar for stabilizing the holder against tipping in any direction relative to the wall panel.

Preferably the base extends in at least two intersecting directions at the spacing S from the anchor bar for contacting the panel at locations spaced about the connector bar, stabilizing the holder against tipping in any direction relative to the wall panel.

DRAWINGS

Figure 2:
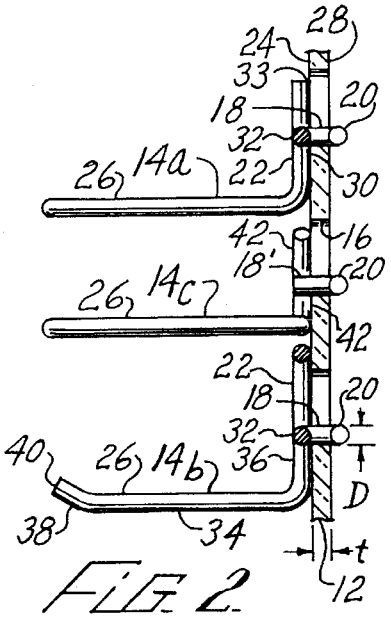
Figure 4:
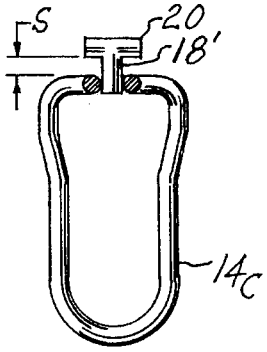
Figure 3:
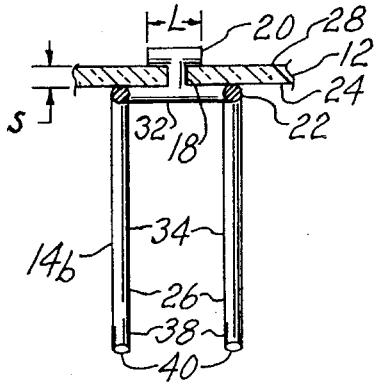

These and other features, aspects, and advantages of the present invention will become better understood with reference to the following description, appended claims, and accompanying drawings, where:

FIG. 1 is a front elevational view of a toolholder system according to the present invention;

FIG. 2 side elevational view of the system of FIG. 1;

FIG. 3 is a plan sectional view of the system of FIG. 1 on line 3—3 thereof; and FIG. 4 a plan sectional view of the system of FIG. 1 on line 4—4 thereof.

DESCRIPTION

The present invention is directed to a toolholder system that is particularly effective, inexpensive, and easy to use. With reference to FIGS. 1–4 of the drawings, a toolholder system 10 includes a slotted panel 12 and a plurality of brackets 14 that are locatable in engagement with selected apertures 16 of the panel 12. The panel 12 has a thickness t that is typically 0.125 inch, the apertures 16 being formed with a width w extending vertically a height h. The apertures 16 are normally formed with full radii to an overall length l that is w plus h, being spaced in a rectangular (typically 1 inch square) array. As shown in the drawings, the brackets 14 can have a variety of configurations as exemplified by a first bracket 14*a*, a second bracket 14*b*, and a third bracket 14*c*. Each of the brackets 14 includes a cylindrical stem member 18 for projecting through a selected one of the apertures 16, an anchor member 20 for passing through the selected aperture 16 when the bracket 14 is rotated to an unlocked position aligning the anchor member 20 with the aperture 16, a base 22 for engaging a front surface 24 of the panel 12, and at least one arm 26 that projects from the base 22 for supporting a tool (not shown) when the bracket 14 is rotated into a locked position as shown by solid lines in FIG. 1, the anchor member 20 engaging a rear surface 28 of the panel 12 in the locked position. Thus the stem member 18 connects the anchor member 20 spaced by a spacing S from the base 22, the spacing S being approximately equal to the thickness t.

The arm 26 of the first bracket 14*a* is U-shaped in plan profile, being L-shaped in side elevational profile, having extremity leg portions 30 that are spaced apart on opposite sides of the stem member 18. A bridge member 32 is rigidly connected between the leg portions 30 at intermediate locations thereon, the stem member 18 being rigidly connected perpendicular to the bridge member 32 midway between opposite ends thereof, the bridge member 32 and the leg portions 30 of the arm 26 being coplanar for forming the base 22. Thus the bridge member 32 functions as a base rod that extends on opposite sides of the stem member 18, the base 22 making contact with the panel 12 along paths that extend in opposite directions on opposite sides of the stem member 18. Accordingly, the base 22 of the bracket 14*a* contacts the panel 12 at a plurality of locations spaced about the stem member 18 for stabilizing the bracket 14 against tipping in any direction relative to the panel 12 when the anchor member 20 is turned out of alignment with the aperture 16.

Preferably, those portions of the anchor member 20 and the base 22 contacting the panel 12 are smoothly convex for permitting the spacing S to be set for a slight interference fit with the panel 12 without subjecting the panel 12 to damage during engagement and/or disengagement of the bracket 14. For this purpose, and for facilitating low-cost production of the bracket 14, the stem member 18, the anchor member 20, and the base 22 are each formed of a rigid wire material having a smoothly convex cross-section. For convenience, the exemplary configurations of the bracket 14 shown in the drawings are formed of metal wire of uniform round cross-section having a diameter D, the diameter D being slightly less than the width w of the aperture 16. Even with the spacing S being such as to create a slight (from 0.0002 inch to 0.002 inch) interference fit, engagement of the bracket 14 with the panel without damage thereto is accomplished by the steps of inserting the anchor member 20 through the aperture 16 to achieve square contact between the base 22 and the front surface 24 of the panel; rotating the bracket 14 about the stem member 18 to the horizontal position; and sliding the bracket downwardly for bringing the stem member 18 against the lower end of the aperture 16. Thus the end extremities of the anchor member 20 need not be spherically or three-dimensionally convex for avoiding damage to the panel 12. It will be understood, however, that the ends of the anchor member 20 can be advantageously formed three-dimensionally convex where contact is made with the rear surface 28 of the panel 12, thereby permitting the steps of rotating and sliding the bracket to be performed in any order without damaging the panel 12. Similarly, the end extremities of the leg portions 30 can be curved slightly away from the panel 12 as indicated at 33 for insuring against damage to the panel 12 when the bracket 14*a* is shifted upwardly relative to the panel 12 in preparation for disengagement of the bracket 14*a*.

The arm 26 of the second bracket 14*b* is also L-shaped in elevational profile, but having extremity leg portions 34 that extend generally perpendicular to the panel 12 for holding a tool, an inverted U-shaped central portion 36 of the arm 26 being connected at opposite ends of a counterpart of the bridge member 32 for forming the base 22, the central portion 36 extending in opposite directions from each end of the bridge member 32 and coplanar therewith for achieving contact with the panel 12 at locations spaced about the stem member 18 to stabilize the bracket 14*b* against tipping in any direction as described above relative to the bracket 14*a*. Opposite end portions 38 of the arm 26 extend as separated arms generally in horizontally spaced relation perpendicular to the base 22 of the bracket 14*b*, respective end extremities 40 of the end portions 38 being inclined slightly upwardly for facilitating retention of a tool or other object on the end portions 38.

Similarly, the arm 26 of the third bracket 14*c* is U-shaped in plan profile, being L-shaped in side elevational profile as for the bracket 14*a*, and having extremity leg portions 42 that extend on opposite sides of the stem member 18. In place of the bridge member 32, the leg portions 42 curve inwardly into contact with opposite sides of a stem member 18' that extends in front of the front surface 24, being rigidly connected perpendicular thereto at intermediate locations on the leg portions 42. The leg portions 42 of the arm 26 are coplanar for forming the base 22, each of the leg portions 42 extending outwardly in intersecting directions on opposite sides of the stem member 18'. Accordingly, the base 22 of the bracket 14*c* contacts the panel 12 at a plurality of locations spaced about the stem member 18' for stabilizing the bracket 14*c* against tipping in any direction relative to the panel 12 as described above.

Although the present invention has been described in considerable detail with reference to certain preferred versions thereof, other versions are possible. For example, The length, shape and/or number of arms on particular ones of the brackets 14 can be altered for supporting a variety of tools and other objects. Therefore, the spirit and scope of the appended claims should not necessarily be limited to the description of the preferred versions contained herein.

What is claimed is:

1. A tool holder for use in a wall panel having a panel thickness, a slotted passage formed through the panel, the passage being of uniform width within a minimum length thereof, comprising:

(a) a cylindrical anchor bar having a lateral thickness not greater than the width of the passage, and a length greater than the width of the passage and not greater than the minimum length of the passage;

(b) a cylindrical connector bar having opposite ends, one end thereof being rigidly connected perpendicular to the anchor bar, the connector bar having a cross-section inscribed within a diameter not greater than the width of the passage, the anchor bar extending beyond opposite sides of the connector bar;

(c) a base rigidly connected to the other end of the connector bar and extending on opposite sides thereof, the base being spaced from the anchor bar by a spacing S not less than the panel thickness; and (d) a U-shaped arm projecting from the base for supporting an article thereon, the base comprising opposite leg portions of the arm, the leg portions being rigidly connected from medial locations thereon to opposite sides of the connector bar, the leg portions being coplanar at the spacing S from the anchor bar.

2. The holder of claim 1, wherein the anchor bar and the connector bar are each circularly cylindrical.

3. The holder of claim 1, wherein the base comprises a base rod of uniform cross-section, the base rod extending on opposite sides of the connector bar at the spacing S.

4. The holder of claim 3, wherein the anchor bar, the connector bar, and the base rod are formed of a wire material having a single uniform cross-section.

5. A tool holder for use in a wall panel having a panel thickness, a slotted passage formed through the panel, the passage being of uniform width within a minimum length thereof, comprising:

(a) a cylindrical anchor bar having a lateral thickness not greater than the width of the passage, and a length greater than the width of the passage and not greater than the minimum length of the passage;

(b) a cylindrical connector bar having opposite ends, one end thereof being rigidly connected perpendicular to the anchor bar, the connector bar having a cross-section inscribed within a diameter not greater than the width of the passage, the anchor bar extending beyond opposite sides of the connector bar;

(c) a base rigidly connected to the other end of the connector bar and extending on opposite sides thereof, the base being spaced from the anchor bar by a spacing S not less than the panel thickness, the base including a base rod of uniform cross-section, the base rod extending on opposite sides of the connector bar at the spacing S; and (d) a U-shaped arm projecting from the base for supporting an article thereon, the base further comprising opposite leg portions of the arm, the leg portions being rigidly connected at medial locations thereon to respective ends of the base rod, the leg portions being coplanar with the base rod at the spacing S from the anchor bar.

6. The holder of claim 5, wherein the leg portions extend to respective end extremities of the arm, a central portion of the arm projecting away from the wall panel.

7. The holder of claim 5, wherein respective end portions of the arm project away from the wall panel.

8. The holder of claim 5, wherein the anchor bar, the connector bar, the base rod and the arm are formed of a wire material having uniform cross-section.

9. The holder of claim 1, wherein the leg portions are formed for contacting the wall panel at at least three spaced locations about the connector bar for stabilizing the holder against tipping in any direction relative to the wall panel.

10. The holder of claim 1, wherein the base extends in at least two intersecting directions at the spacing S from the anchor bar for contacting the panel at locations spaced about the connector bar, stabilizing the holder against tipping in any direction relative to the wall panel.

11. A tool holder for use in a wall panel having a panel thickness, a slotted passage formed through the panel, the passage being of uniform width within a minimum length thereof, comprising:

(a) a circularly cylindrical anchor bar having a length greater than the width of the passage and not greater than the minimum length of the passage;

(b) a circularly cylindrical connector bar having the anchor bar extending beyond opposite sides of the connector bar;

(c) a base rigidly connected to the other end of the connector bar and extending on opposite sides thereof, the base being spaced from the anchor bar by a spacing S not less than the panel thickness, the base extending in at least two intersecting directions on opposite sides of the connector at the spacing S from the anchor bar for contacting the panel at locations spaced about the connector bar and stabilizing the holder against tipping in any direction relative to the wall panel when the connector bar protrudes the passage with the anchor bar extending on opposite sides of the passage; and (d) a U-shaped arm member, the base comprising opposite leg portions of the arm member, the leg portions being rigidly connected from medial locations thereon to opposite sides of the connector bar, the leg portions being coplanar at the spacing S from the anchor bar, a portion of the arm member projecting from the base for supporting an article thereon, the arm member, the base, the anchor bar and the connector bar being formed of a wire material having a single uniform circular cross-sectional diameter that is not greater than the width of the passage.

* * * * *